US009670744B1

(12) United States Patent
Stave

(10) Patent No.: US 9,670,744 B1
(45) Date of Patent: Jun. 6, 2017

(54) DRILLING FLUID CIRCULATION SYSTEM

(71) Applicant: Roger Sverre Stave, Bergen (NO)

(72) Inventor: Roger Sverre Stave, Bergen (NO)

(73) Assignee: SJO DRILLING AS (NO)

( * ) Notice: Subject to any disclaimer, the term of this patent is extended or adjusted under 35 U.S.C. 154(b) by 0 days.

(21) Appl. No.: 15/259,088

(22) Filed: Sep. 8, 2016

(51) Int. Cl.

| | |
|---|---|
| ***E21B 7/12*** | (2006.01) |
| ***E21B 17/01*** | (2006.01) |
| ***E21B 21/08*** | (2006.01) |
| ***E21B 21/00*** | (2006.01) |

(52) U.S. Cl.
CPC ..... *E21B 21/08* (2013.01); *E21B 7/12* (2013.01); *E21B 17/01* (2013.01); *E21B 21/001* (2013.01)

(58) Field of Classification Search
CPC ..... E21B 7/12; E21B 17/01; E21B 21/001; E21B 21/08
See application file for complete search history.

(56) References Cited

U.S. PATENT DOCUMENTS 4,063,602 A * 12/1977 Howell ..... E21B 7/128 175/48
4,291,772 A 9/1981 Beynet
5,168,932 A * 12/1992 Worrall ..... E21B 21/001 166/336
6,454,022 B1 9/2002 Sangesland et al.
6,966,367 B2 * 11/2005 Butler ..... E21B 21/001 166/105
9,057,233 B2 * 6/2015 Ree ..... E21B 21/001
9,316,054 B2 * 4/2016 Weinstock ..... E21B 7/12
2012/0227978 A1 * 9/2012 Fossli ..... E21B 21/001 166/363

* cited by examiner

*Primary Examiner* — Matthew R Buck
(74) *Attorney, Agent, or Firm* — Richard A. Fagin; Adenike Adebiyi

(57) ABSTRACT

A method for marine wellbore drilling includes pumping drilling fluid through a drill pipe in a wellbore below a bottom of a drilling riser extending from proximate the bottom of the water to a drilling platform on the surface. Drilling fluid returning from the wellbore is discharged from a position proximate the bottom of the drilling riser into a fluid line extending from the position to the platform. Drilling fluid in the fluid line is pumped from a depth in the body of water shallower than the position of discharge of fluid from the riser and at which a column of fluid in the marine drilling riser at an elevation above an intake of a pump in the fluid line exerts a dynamic fluid pressure exceeding fluid pressure at the intake of the pump. The riser fluid level is selected to provide a selected fluid pressure in the wellbore.

5 Claims, 3 Drawing Sheets

DRILLING FLUID CIRCULATION SYSTEM

BACKGROUND

This disclosure relates to the field of marine well drilling. More specifically the disclosure relates to systems for marine well drilling having a pump in a drilling fluid return line to add energy to drilling fluid returning from a well to a drilling platform.

Marine drilling from a platform above the surface of a body of water may include drilling a "surface" section of a wellbore to a selected depth in formations below the water bottom. A "surface casing" or conduit may then be inserted into the surface section of the wellbore and cemented in place. After the surface casing is set in place, a well pressure control apparatus, such as a subsea "blowout preventer" (BOP) with a lower marine riser package (LMRP) may be coupled to the upper end of the surface casing, which is usually located proximate the water bottom. After the BOP/LMRP are assembled to the surface casing, a marine drilling riser is assembled on the platform and is ultimately coupled to the LMRP and extends therefrom to the platform proximate the surface of the body of water. There are other ways to assemble the foregoing components. In another embodiment, the LMRP is assembled to the bottom of and forms part of the marine drilling riser and an emergency disconnect, The LMRP may be disconnected from the BOP. In deep water the BOP is normally run suspended at the bottom of the LMRP when the riser is run in order to save the time required to "trip" the BOP into the body of water separately from the riser.

The marine drilling riser may be assembled from segments of conduit having flanges coupled to the longitudinal ends of each conduit segment. Assembly of the riser may include bolting the flanges together end to end until the required length of riser is formed. The riser in some embodiments may be a relatively large diameter conduit, e.g., between 16 and 30 inches in diameter to enable free passage therethrough of various drilling tools used to extend, by drilling, the length of the wellbore below the bottom of the surface casing.

Marine drilling riser may comprise one or more fluid lines extending outside of and generally parallel to the marine drilling riser. Such fluid lines may include, e.g., a choke line, a kill line and a booster line. The choke line and kill line may have fluid connections to a point below the BOP so that fluid pressure in the wellbore may be adjusted and/or controlled by pumping fluid into the kill line and/or controlling fluid discharge from the wellbore through the choke line. The choke line may have a controllable flow restriction (e.g., a variable orifice choke) disposed at the end of the choke line proximate or on the platform. The booster line may be used to pump additional drilling fluid into an annular space between the interior of the riser and the exterior of the drilling tools (e.g., drill pipe) extending through the riser so as to increase velocity of drilling fluid returning from the wellbore. The increased velocity may be required in some circumstances to lift drill cuttings from the wellbore below the BOP to the platform through the riser; the velocity of the returning drilling fluid may in some cases drop below that required to lift cuttings as the returning drilling fluid enters the marine drilling riser because of its relatively large diameter.

Marine drilling systems that provide a pump for returning drilling fluid to the platform are described, for example in U.S. Pat. No. 4,291,772 issued to Beynet and U.S. Pat. No. 6,454,022 issued to Sangesland et al. In the foregoing patents, the riser is described as being hydraulically opened to the wellbore below. In order to maintain a hydrostatic pressure in the wellbore annulus that is lower than would be provided if the entire length of the marine drilling riser were filled with drilling fluid of the same density as that pumped from the platform into the drilling tools, the riser may be partially or totally filled with sea water or air. As the drilling fluid leaves the wellbore annulus (the space between the drill pipe and the wellbore wall), it is diverted, through suitable valves to a line connected to the inlet of a pump (called a mudlift pump) that lifts the drilling fluid to the surface through a separate fluid return line. Typically, the mudlift pump is operated so that the interface between the drilling mud and the water or air column above in the riser is maintained at a selected depth level. Maintaining the selected level causes a selected hydrostatic pressure to be maintained in the wellbore.

There is a significant difference between the density of seawater and air or gas. As an example; if the entire effect of water depth is to be eliminated, and the riser is seawater filled, the drilling fluid/seawater interface may be placed close to seafloor and riser boost is not needed. If air or gas is used above the drilling fluid level in the riser, the interface is typically shallower than a drilling fluid/seawater interface for the same drilling fluid density in order to exert the same bottom hole pressure (BHP) in the well below the water bottom. In this case riser boost is needed in order to avoid cuttings build up in the drilling riser due to the large diameter and corresponding low fluid velocity if additional flow into the riser is not provided. The riser boost flow may in many cases be more than the drilling fluid circulation rate through the wellbore and thereby may comprise more than 50% of the rated flow for the mudlift pump, depending on the rated flow capacity of the mudlift pump.

In systems such as described in the foregoing two patents, the mudlift pump is located either proximate or just above the BOP and LMRP and is connected at its inlet from a fluid outlet on the marine drilling riser proximate the inlet of the mudlift pump. In the Sangesland et al. '022 patent, the fluid outlet from the riser is elevated a substantial distance from the BOP/LMRP and the mudlift pump inlet is proximate to the fluid outlet on the marine drilling riser.

For the apparatus described in the Sangesland '022 patent there is a minimum depth at where the mudlift pump can be placed in relation to its suction pressure; the hydrostatic pressure of the mud column inside the drilling riser needs to be greater than the frictional losses through the pump suction line. It would typically be better to position the mudlift pump somewhat deeper in order provide higher suction pressure/better margin. The differential pressure, pump head and pump horsepower required will remain the same as these parameters depend on the drilling fluid density (mud weight), drilling fluid flow rate and the riser fluid interface level from the mud level inside the drilling riser that is to be lifted back to surface. Elevating the pump as disclosed in the Sangesland patent will for the most part still require riser boost flow in order to transport drill cuttings up the riser annulus. The riser boost flow will then need to be lifted back to surface using the mudlift pump in addition to lifting the flow of drilling fluid that is pumped into the well through the drill pipe. This will necessitate larger pump size and horsepower as compared to the system disclosed in the Beynet '772 patent for any specific mud weight, drilling fluid circulation rate through the well (open hole) and bottom hole pressure.

By way of example, mudlift systems known in the art may have one or more of the following limitations. Drilling fluid return flow in the marine drilling riser needs boost flow to ensure proper drill cuttings transport. The boost flow requirement is a factor that determines the boost (e.g., mudlift) pump size. If a separate mud return line is used, for example as shown in the foregoing two patents to Beynet and Sangesland et al, such lines need to be installed onto the exterior of the riser in the moon pool or similar opening through the hull of a drilling platform. The moon pool may already be congested by reason of the riser and external lines being installed thereon. Thus a separate mud return line may require substantial rig and riser modifications. Such modifications may increase riser assembly time and installation cost.

In a controlled mud level system, e.g., as described in the Sangesland et al. patent, the formula for mudlift pump horsepower can be simplified as follows:

$$N=f(Q*p*C)$$

where; N=pump horsepower (hp); Q=return fluid flow rate (gallons per minute—gpm); Δp=boost pump head (in psi) and C is a proportionality constant. Variations in pipe pressure losses have been ignored in the above expression as they will not be significant for this comparison.

The total flow through the drilling riser to be able to carry drill cuttings to surface will typically be on the order of 1800-2000 gpm. For a 17½ inch diameter drilled wellbore the flow will typically be 1200-1600 gpm. For a 12¼ inch diameter drilled wellbore the flow will be 700-1000 gpm, and for an 8½ inch diameter wellbore the flow will be about 400-600 gpm. The increase in flow required by using riser boost may be observed in Table 1.

TABLE 1

| Well diameter (inch) | Flow Rate Open Hole (gpm) | Riser Flow (incl boost) | Boost % of Flow |
|---|---|---|---|
| 17½ | 1200-1600 | 1800-2000 | 20-35 |
| 12¼ | 700-1000 | 1800-2000 | 50-60 |
| 8½ | 400-600 | 1800-2000 | 70-80 |

It is desirable to reduce or eliminate the need for riser boost flow without the need for installation of a separate mud return line.

DETAILED DESCRIPTION

Figure 1:
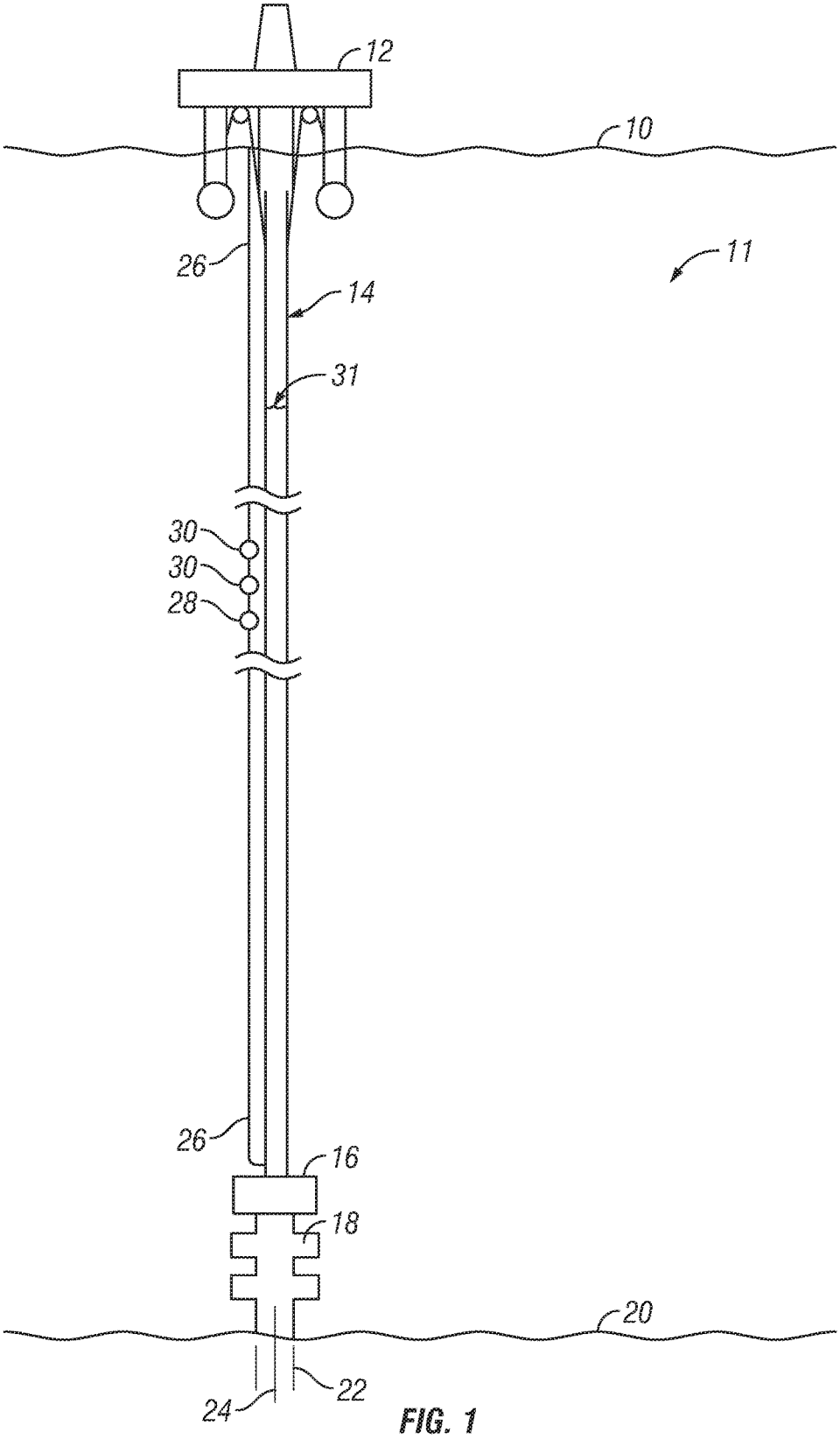
FIG. 1 shows an example embodiment of a marine drilling system including an embodiment of a boost line disposed mudlift pump.

An example embodiment of a marine wellbore drilling system including a mudlift pump and connecting fluid lines according to various aspects of the present disclosure is shown schematically in FIG. 1. A drilling platform 12 may be disposed above the surface 10 of a body of water 11. The drilling platform 12 may be a floating platform such as a semisubmersible platform or a drill ship, or may be a bottom supported platform such as a "jackup" mobile offshore drilling unit. The type of drilling platform is not a limit on the scope of the present disclosure.

A surface casing 22 of a wellbore extends for a selected distance below the water bottom 20 into formations below the water bottom 20. A well pressure control apparatus such as a subsea blowout preventer (BOP) 18 may be coupled to the upper end of the surface casing 22. A lower marine riser package 16 (LMRP) may be coupled to the upper end of the BOP 18. A marine drilling riser ("riser") 14 extends from the LMRP 16 to the drilling platform 12. Fluid lines external to the riser 14 such as a choke line and a kill line ordinarily used in conjunction with the riser 14 are omitted from FIG. 1 for clarity of the illustration. A fluid line 26 is shown extending from just above the LMRP 16 to the drilling platform 12. The fluid line 26 may be the existing boost line that is reconfigured to perform the functions of a mud suction line below mudlift pump(s) 28, 30 and a mud return line above the mudlift pump(s) 28, 30. Using the existing boost line, e.g., line 26, for a controlled mud level drilling may provide significant saving in cost, size of the riser and its associated fluid lines and riser assembly/disassembly time. If the existing boost line or other existing riser auxiliary fluid line (e.g., choke line or kill line) is not used as explained above for drilling fluid return then the entire length of riser would need to be modified with an additional fluid line. Also in such cases a flexible line would need to be installed on the riser exterior in a congested moon pool area of the platform 12. As explained in the Background section herein, the ordinary use of the boost line (fluid line 26) is to enable additional drilling fluid to be pumped into the riser 14 proximate its lower end so as to increase velocity of drilling fluid returning to the drilling platform 12. The increased velocity helps lift drill cuttings to the drilling platform 12. During well drilling and related drilling operations, drilling fluid may be pumped into the wellbore below the surface casing 22 through a conduit comprising drill pipe 24. Devices for pumping drilling fluid into the drill pipe 24 and for processing returned drilling fluid are omitted from FIG. 1 for clarity of the illustration.

In the present example embodiment, at a selected depth below the water surface 10, the boost line 26 may comprise at least one mudlift pump 28. In some embodiments, more than one mudlift pump, e.g., as shown at 30 may be coupled in series/parallel with the mudlift pump 28.

In the present example embodiment, the riser 14 may be coupled to the LMRP 16 and BOP 18 so that during ordinary drilling conditions (i.e., no fluid entering the wellbore from a formation or being lost to a formation) the riser 14 is open to the wellbore annulus the space between the interior of the riser 14 and the exterior of the drill pipe 24). A selected amount of hydrostatic pressure is maintained on the formations in the wellbore below the surface casing 22 by maintaining a fluid level 31 in the riser 14 at a selected elevation (which may be below the drilling platform 12 and above the water bottom 20). The hydrostatic pressure at any selected depth in the wellbore will be related to: (i) the total height of the drilling fluid column from the fluid level 31 to a selected depth in the wellbore; and (ii) the density of the drilling fluid. The hydrostatic pressure P may be expressed in pounds per square inch by the formula:

$$P=MW(\text{ppg})*(0.052)*h \quad (1)$$

wherein MW represents the drilling fluid density expressed in pounds per gallon and h represents the total height of the drilling fluid column in feet.

In the present example embodiment, the drilling fluid level 31 may be maintained at a selected elevation H1 above the depth of the mudlift pump 28 so that the hydrostatic pressure exerted by the drilling fluid from the drilling fluid level 31 to the depth of the mudlift pump (referred to as P1) exceeds the pressure drop in the boost line 26 between the connection point of the boost line 26 to the riser 14 and the inlet of the mudlift pump 28, referred to as PL. PL may be calculated by the expression:

$$PL=C*MW*L*Q \quad (2)$$

wherein C is a proportionality constant that is related to the diameter of the boost line and rheological properties of the drilling fluid, L is the vertical length of the boost line from the riser connection to the mudlift pump inlet and Q is the drilling fluid flow rate (usually expressed in barrels or gallons per minute). PL may be defined as the dynamic or flowing suction pressure of the mudlift pump.

In some embodiments, the mudlift pump 28 may be disposed at a depth which is substantially below the water surface 10, and at the same time at considerable height above the water bottom 20. The meaning of "a depth which is substantially below the water surface, and at the same time at considerable height above the water bottom" is a depth which preferably is about a hundred meters or deeper below the water surface, and not as deep as the total water depth, but preferably several hundred meters above the water bottom, except from the occasions where the water depth is so shallow that the mudlift pump 28 may be arranged just above the water bottom 20.

In the present example embodiment at the flow rate Q, PL is less than P1. In the present example embodiment, the amount by which PL is less than P1 may be minimized such that the flow rate of drilling fluid into the boost line 26 is the same as the flow rate of drilling fluid into the drill pipe 24, thus maintaining the drilling fluid level 31. As explained above, the drilling fluid level 31 may be maintained such that hydrostatic pressure in the wellbore is sufficient to prevent fluids from entering the wellbore from exposed formations in the wellbore. In the present example embodiment, the mudlift pump 28 may be placed at a depth that enables PL to be less than P1. Such pump depth will provide positive suction pressure at the pump inlet. Ignoring the mudlift pumps required Net Positive Suction Head (NPSH) the pressure should typically be above atmospheric pressure to avoid pump cavitation. By placing the mudlift pump at such depth, it may be possible to maintain full flow of the drilling fluid out of the wellbore into the lower end of the boost line 26 while minimizing the required head generated by the mudlift pump 28 to return drilling fluid and entrained cuttings to the drilling platform 12. Correspondingly, by using the boost line 26 or similar small diameter line to return drilling fluid from proximate the BOP 18 or LMRP 16 it may be possible to maintain sufficient velocity of the drilling fluid return to entrain drill cuttings without the need for riser boost flow. The depth at which the pump(s) may be placed depends on the drilling fluid density (mud weight) and equivalent circulating density (ECD) reduction desired. The pump head and horsepower increases with fluid level reduction and pump depth in the water column. If boost flow were to be added such flow would significantly increase the horsepower required to be exerted by the pump(s) 28, 30. Thus by eliminating the need for riser boost flow, the power requirements for the pump(s) 28, 30 may be correspondingly reduced.

In one example embodiment, the pump(s) 28, 30 may be disposed at the shallowest depth for which PL is less than P1 where the value of P1 is determined by the required drilling fluid level in the riser 14. The required fluid level is that which enables the column of drilling fluid in the riser 14 and in the wellbore below the BOP to exert sufficient hydrostatic pressure so as to prevent fluid influx into the wellbore below the depth of the surface casing.

Figure 3:
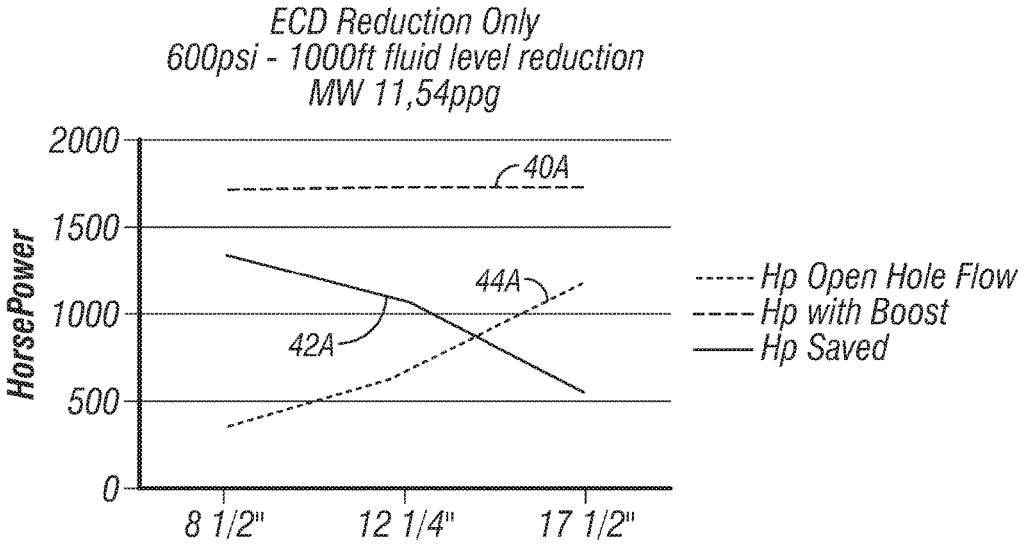
FIG. 3 shows a graph of drilling fluid return pump horsepower required to provide boost flow into the base of a drilling riser, flow in open hole using a mudlift pump according to the present disclosure and required horsepower reduction using a mudlift pump as disclosed herein. The graphs are for a drilling fluid column lowered from the surface by 1,000 feet and a drilling fluid density of 11.54 ppg.
Figure 4:
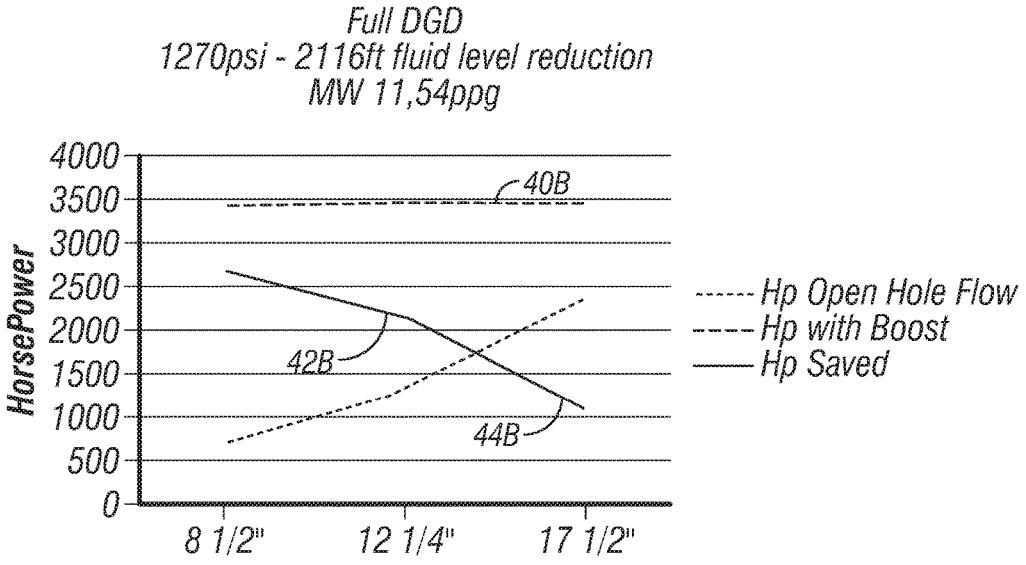
FIG. 4 shows graphs similar to FIG. 3 but wherein the fluid column in the riser is lowered to 2116 feet below the surface.

Examples are shown graphically in FIGS. 3 and 4. FIG. 3 shows a graph of drilling fluid return pump horsepower required to provide boost flow into the base of a drilling riser at 40A, flow in open hole using a mudlift pump according to the present disclosure at 42A and required horsepower reduction using a mudlift pump as disclosed herein at 44A The graphs are for a drilling fluid column lowered from the surface by 1,000 feet and a drilling fluid density of 11.54 ppg. FIG. 4 shows graphs corresponding to those shown in FIG. 3 at 40B, 42B, 44B but wherein the fluid column in the riser is lowered to 2116 feet below the surface.

Figure 2:
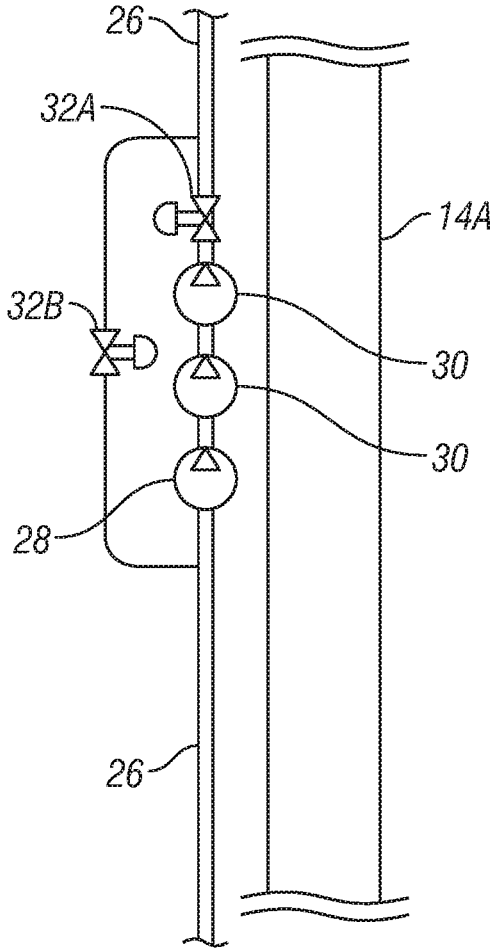
FIG. 2 shows an example embodiment of control valves operable to reconfigure a riser boost line to be used for its ordinary purpose from use as a drilling fluid return line as in FIG. 1.

In the event the user desires to operate the drilling system of FIG. 1 in a conventional manner in which boost flow is pumped from the drilling platform 12 down the boost line 26 to the base of the riser 14, and with reference to FIG. 2, the riser segment 14A at which the mudlift pump 28 is located may include a pump bypass valve 32B in the boost line, which may be opened, and a pump shutoff valve 32A, which may be closed, so that the boost line may be used in the ordinary manner. When it is desired to reconfigure the drilling system to operate as explained with reference to FIG. 1, the bypass valve may be closed and the pump shutoff valve 32A may be opened.

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112(f), for any limitations of any of the claims herein, except for those in which the claim expressly uses the words "means for" together with an associated function.

What is claimed is:

1. A method for marine wellbore drilling, comprising:

pumping drilling fluid through a drill pipe in a wellbore, the wellbore disposed below a bottom of a marine drilling riser extending from proximate the bottom of a body of water to a drilling platform on the surface of the body of water;

discharging drilling fluid returning from the wellbore from a position proximate the bottom of the marine drilling riser into a fluid line extending from the position to the drilling platform; and pumping the drilling fluid in the fluid line with a pump in the fluid line from a depth in the body of water shallower than the position of discharging fluid and at which a column of fluid in the marine drilling riser is at an elevation such that the column of fluid exerts a fluid pressure exceeding a dynamic fluid pressure at an intake of the pump, the dynamic fluid pressure at the intake of the pump being a pressure drop in the fluid line between the position and the intake of the pump, wherein the elevation of the column of fluid in the marine drilling riser is selected to provide a selected fluid pressure in the wellbore.

2. The method of claim 1 wherein the fluid line comprises a riser boost line.

3. The method of claim 1 further comprising bypassing the pump in the fluid line and pumping riser boost fluid from the drilling platform into the fluid line to the position proximate the bottom of the riser.

4. The method of claim 1 wherein the pumping is performed at a shallowest depth in the water at which a fluid pressure at the intake of the pump is exceeded by pressure of fluid in the fluid line resulting from the elevation of the fluid column and the pressure of pumping the drilling fluid through the drill pipe.

5. The method of claim 1 wherein the pumping is performed at a depth which is substantially below the water surface, and at the same time at considerable height above the water bottom.

* * * * *